US011753820B2

(12) United States Patent
De La Cruz

(10) Patent No.: US 11,753,820 B2
(45) Date of Patent: Sep. 12, 2023

(54) INTERLOCKING MODULAR BLOCK SYSTEM

(71) Applicant: New Century International LLC, Miami, FL (US)

(72) Inventor: Alex De La Cruz, Miami, FL (US)

(73) Assignee: New Century International LLC, Miami, FL (US)

( * ) Notice: Subject to any disclaimer, the term of this patent is extended or adjusted under 35 U.S.C. 154(b) by 124 days.

(21) Appl. No.: 17/541,718

(22) Filed: Dec. 3, 2021

(65) Prior Publication Data

US 2023/0175253 A1 Jun. 8, 2023

(51) Int. Cl.

| | |
|---|---|
| ***E04B 2/18*** | (2006.01) |
| ***E04B 2/22*** | (2006.01) |
| *E04B 2/02* | (2006.01) |

(52) U.S. Cl.

CPC ..... *E04B 2/18* (2013.01); *E04B 2/22* (2013.01); *E04B 2002/021* (2013.01)

(58) Field of Classification Search

CPC ..... E04B 2/18; E04B 2/22; E04B 2002/021; E04B 2/16; E04B 2/24; E04B 2/52; E04B 2/56

See application file for complete search history.

(56) References Cited

U.S. PATENT DOCUMENTS

| | | | | |
|---|---|---|---|---|
| 2,001,469 | A * | 5/1935 | Munson | E04B 2/18 52/592.4 |
| 4,290,426 | A | 9/1981 | Hilsey | |
| 5,181,362 | A * | 1/1993 | Benitez | E04B 2/18 52/591.1 |
| 6,412,244 | B2 | 7/2002 | Nolan | |
| 6,907,704 | B2 | 6/2005 | Abang et al. | |
| 6,996,945 | B2 | 2/2006 | Doty | |
| 7,905,070 | B2 | 3/2011 | August | |
| 8,176,696 | B2 | 5/2012 | LeBlang | |
| 8,713,871 | B2 | 5/2014 | Wallin | |
| 2008/0229698 | A1 | 9/2008 | Ulguner | |
| 2012/0279163 | A1 | 11/2012 | MacDonald et al. | |
| 2014/0230357 | A1* | 8/2014 | Kovitch | E04B 2/08 52/588.1 |
| 2014/0270990 | A1 | 9/2014 | Heraty | |
| 2016/0123004 | A1* | 5/2016 | Lightfoot | E04B 2/08 52/286 |

FOREIGN PATENT DOCUMENTS

| | | | | |
|---|---|---|---|---|
| FR | 2523624 | A1 * | 9/1983 | E04C 1/40 |

* cited by examiner

*Primary Examiner* — Patrick J Maestri
(74) *Attorney, Agent, or Firm* — Mark Terry

(57) ABSTRACT

A interlocking modular block system for structure assembly includes a solid prestressed concrete post having a square cross-sectional shape, a first hollow cuboid shaped block having a triangular cutout on each of its two opposing sides, a second hollow cuboid shaped block having the triangular cutouts on each of its two opposing sides, a first hollow cubic shaped block with a triangular prism shaped protrusion on each of three consecutive walls, configured to join three walls, a second hollow cubic shaped block with a triangular prism shaped protrusion on each of two opposing walls, configured to join two colinear walls, a third hollow cubic shaped block with a triangular prism shaped protrusion on one wall, configured to terminate a wall, and, a fourth hollow cubic shaped block with a triangular prism shaped protrusion on each of two consecutive walls, configured to join two perpendicular walls.

18 Claims, 11 Drawing Sheets

INTERLOCKING MODULAR BLOCK SYSTEM

CROSS-REFERENCE TO RELATED APPLICATIONS

Not Applicable.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

FIELD OF THE INVENTION

The invention disclosed broadly relates to the field of construction, and more particularly relates to the field of modular building systems for residential and commercial construction purposes.

BACKGROUND OF THE INVENTION

Modular building systems have existed for many years, and typically involve the fabrication of the modular components at one or more central facilities, which then requires shipping of said components to the construction site. There are exorbitant costs associated with shipping in general, as well as significant time and effort exerted in constructing functional buildings with structural integrity. These traditional methods involve shipping an exceedingly high quantity of heavy materials, sometimes internationally, which imposes an undue burden, both in terms of cost and time, on both the manufacturers and the consumers. In terms of cost, the task of shipping large quantities of heavy materials over substantial distances infringe on the manufacturer's profit margin and, should those costs be imposed upon consumers, can make owning a home inaccessible to those of modest means. To make owning a home inaccessible to those of modest means perpetuates the cycle of poverty in low-income communities and prevents the accumulation of generational wealth, negatively impacting families, communities, and at times, entire nations, raising concerns regarding social mobility. In terms of time, it is in the manufacturer's best interest to construct as many buildings as possible within tight time constraints to prevent incurring more labor costs than necessary and to be in possession of more inventory to sell to consumers. In terms of inventory, failing to construct more buildings affordably and efficiently inflicts a net social harm as it deters from the economic development of businesses and the social mobility of individuals and families.

Another problem facing construction in general is the use of mortar. The use of mortar in construction amplifies the difficulties associated with constructing buildings more affordably and efficiently by imposing unnecessary costs in terms of shipping and preparation, as mortar must be mixed with water, which is a time-consuming and costly process.

Once the materials are shipped and properly prepared, they are difficult to assemble, which imposes additional labor costs as laborers take more time to ensure structural integrity and prevent a deadly collapse that would open the manufacturer to significant liability, as well as raise concerns regarding safety and ethics.

Because of the aforementioned defects, it becomes necessary to improve upon the prior art. Therefore, a need exists to overcome the problems with the prior art as discussed above, and particularly for a more effective and efficient modular building process.

SUMMARY OF THE INVENTION

Briefly, according to one embodiment, an interlocking modular block system for structure assembly includes a solid prestressed concrete post having a square cross-sectional shape, a first hollow cuboid shaped block of a first size, having a triangular cutout on each of its two opposing sides, wherein each triangular cutout is configured to mate with an instance of said post, a second hollow cuboid shaped block of a second size longer than the first size, having said triangular cutouts on opposing sides, a first hollow cubic shaped block with a triangular prism shaped protrusion on each of three consecutive walls, including a square shaped bore configured to securely accept said post, wherein said first hollow cubic shaped block is configured to join three walls and wherein said triangular prism shaped protrusion is configured to mate with an instance of said triangular cutout, a second hollow cubic shaped block with a triangular prism shaped protrusion on each of two opposing walls, including a square shaped bore configured to securely accept said post, wherein said second hollow cubic shaped block is configured to join two colinear walls, a third hollow cubic shaped block with a triangular prism shaped protrusion on one wall, including a square shaped bore configured to securely accept said post, wherein said third hollow cubic shaped block is configured to terminate a wall, and, a fourth hollow cubic shaped block with a triangular prism shaped protrusion on each of two consecutive walls, including a square shaped bore configured to securely accept said post, wherein said fourth hollow cubic shaped block is configured to join two perpendicular walls.

The foregoing and other features and advantages of the claimed embodiments will be apparent from the following more particular description of the preferred embodiments, as illustrated in the accompanying drawings.

BRIEF DESCRIPTION OF THE DRAWINGS

The accompanying drawings, which are incorporated in and constitute a part of this disclosure, illustrate various example embodiments. In the drawings.

DETAILED DESCRIPTION

Figure 1:
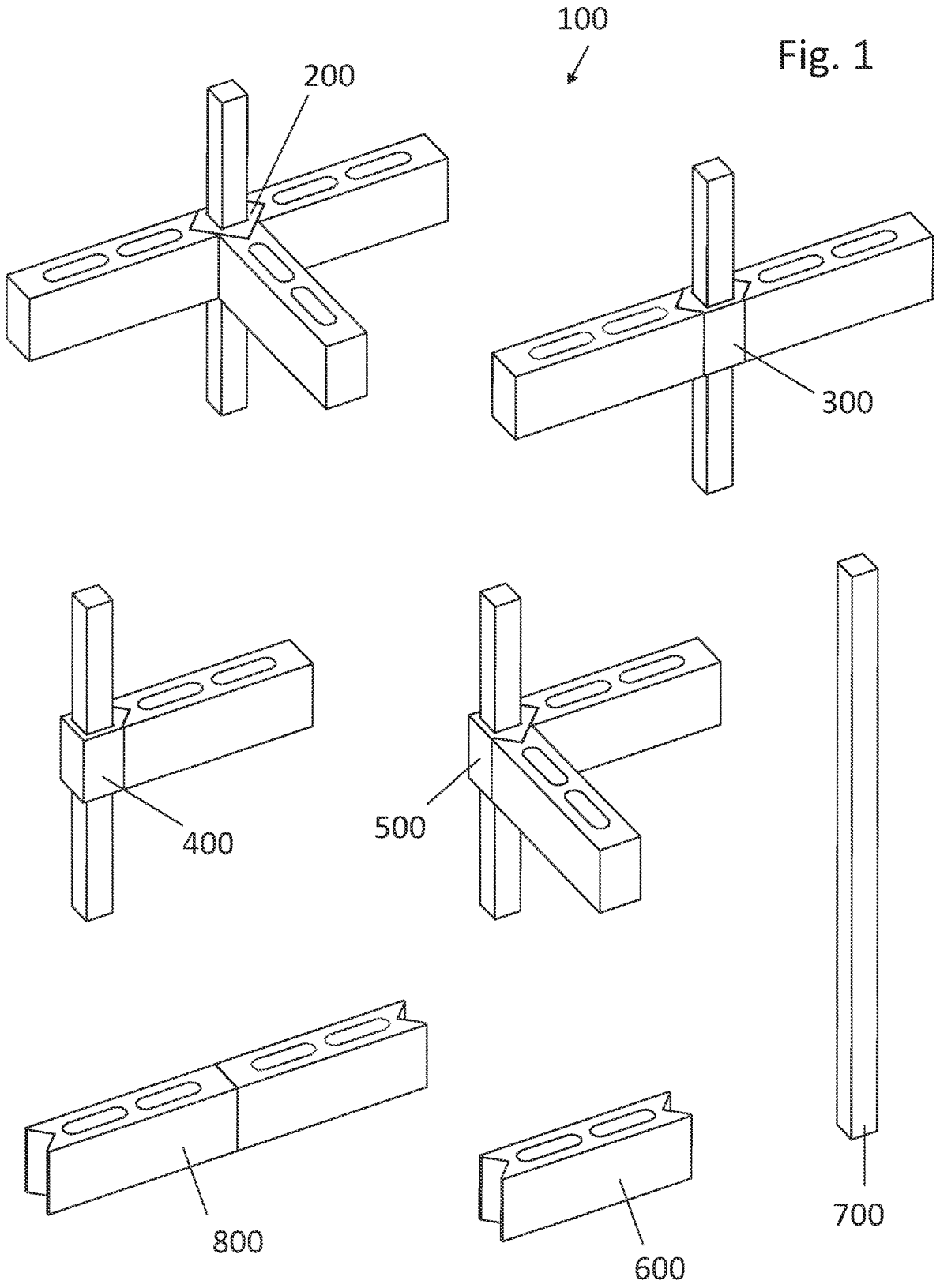
FIG. 1 is an illustration of the main components of an interlocking modular block system, in accordance with one embodiment.

The following detailed description refers to the accompanying drawings. Wherever possible, the same reference numbers are used in the drawings and the following description to refer to the same or similar elements. While embodiments may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the claimed subject matter. Instead, the proper scope of the claimed subject matter is defined by the appended claims.

The claimed subject matter improves over the prior art by providing an improved interlocking modular block system that is more efficient and easier to utilize than prior art modular block systems. Applicant's claimed embodiments further address problems with the prior art modular block systems by conserving valuable time, energy, and costs associated with shipping and preparation of the claimed interlocking modular block system. This is achieved through a simpler construction process with rudimentarily shaped blocks, the reduction or elimination of the use of mortar, while also reducing or eliminating the need to ship materials to the construction site. The claimed subject matter utilize standard modular blocks that vary in limited forms, as well as posts, to simplify the construction of structurally sound buildings, conserving laborer's time and in turn, reducing labor costs. Said system reduces or eliminates the need for the use of mortar, saving costs associated with materials. The manner in which the blocks interconnect and provide solid, stable connections reduces or eliminates the need for the use of mortar. Said modular block can be easily manufactured in developing nations, eliminating exorbitantly high shipping costs and the time associated with international shipments.

The claimed subject matter will now be described with reference to the FIGS. 1-14. FIG. 1 is an illustration of the main components of an interlocking modular block system 100, in accordance with one embodiment. FIG. 1 shows a solid prestressed concrete post 700. Prestressed concrete is a form of concrete used in construction wherein the concrete is substantially prestressed (compressed) during production, in a manner that strengthens it against tensile forces which will exist when in service. This compression is produced by the tensioning of high-strength tendons located within or adjacent to the concrete and is done to improve the performance of the concrete in service. The concrete post 700 has a substantially square cross-sectional shape. Note that when said square shape is rotated 45 degrees, the shape is akin to a diamond. The purpose of the post 700 is to secure it to the ground using a concrete base, so as to provide a vertical structure to which the other block in this figure are attached.

FIG. 1 also shows a first hollow cuboid shaped block 600 (also referred to as a wall block) with triangular cutouts on opposing sides designed to fit post 700. FIG. 1 further shows a second hollow cuboid shaped block 800 (also referred to as a wall block) with triangular cutouts on opposing sides designed to fit post 700, similarly to first hollow cuboid shaped block 600, but more elongated. In one embodiment the wall block 800 is twice as large as the wall block 600. In one embodiment, the triangular cutouts define about a 90-degree angle (same applies to other cutouts described herein).

A cuboid is a convex polyhedron bounded by six quadrilateral faces, whose polyhedral graph is the same as that of a cube. Each of the faces of the cuboid is a rectangle and so each pair of adjacent faces meets in a right angle. The triangular cutouts are depressions. cavities or sunken areas that are negative spaces configured to match the triangular prism shaped protrusions described below.

FIG. 1 additionally shows a first hollow cubic shaped block 200 (also referred to as a T-joint block) with three triangular prism shaped protrusions protruding from three adjacent and consecutive sides, and a fourth flat side. In the center of the block is a bore configured to accept the insertion of, and mate securely with, post 700. The triangular prism shaped protrusions are shaped to fit securely within, or mate with, the triangular cutouts of the wall blocks.

A cubic shape refers to a cube which is a three-dimensional object bounded by six square faces, facets, or sides, with three faces meeting at each vertex. Block 200 is cubic in the sense that it comprises a cube comprises of four concrete square, or square-like, faces, sides or walls, wherein three of said faces, sides or walls include a triangular prism shaped protrusion that has been added onto said face, side, or wall. A triangular prism is a three-sided prism, comprising a polyhedron made of a triangular base, a translated copy of said triangular base, and three rectangular faces joining corresponding sides.

FIG. 1 additionally shows a second hollow cubic shaped block 300 (also referred to as an intrawall block) with triangular prism shaped protrusions protruding from two opposing sides, and two opposing flat sides. In the center of the block is a bore configured to accept the insertion of, and mate securely with, post 700.

Also shown is a third hollow cubic shaped block 400 (also referred to as an end block) with a triangular prism shaped protrusion on one side, and three flat sides. In the center of the block is a bore configured to accept the insertion of, and mate securely with, post 700. FIG. 1 also shows a fourth hollow cubic shaped block 500 (also referred to as a corner block) with the triangular prism shaped protrusions on two adjacent sides, and two adjacent flat sides. In the center of the block is a bore configured to accept the insertion of, and mate securely with, post 700.

Figure 2:
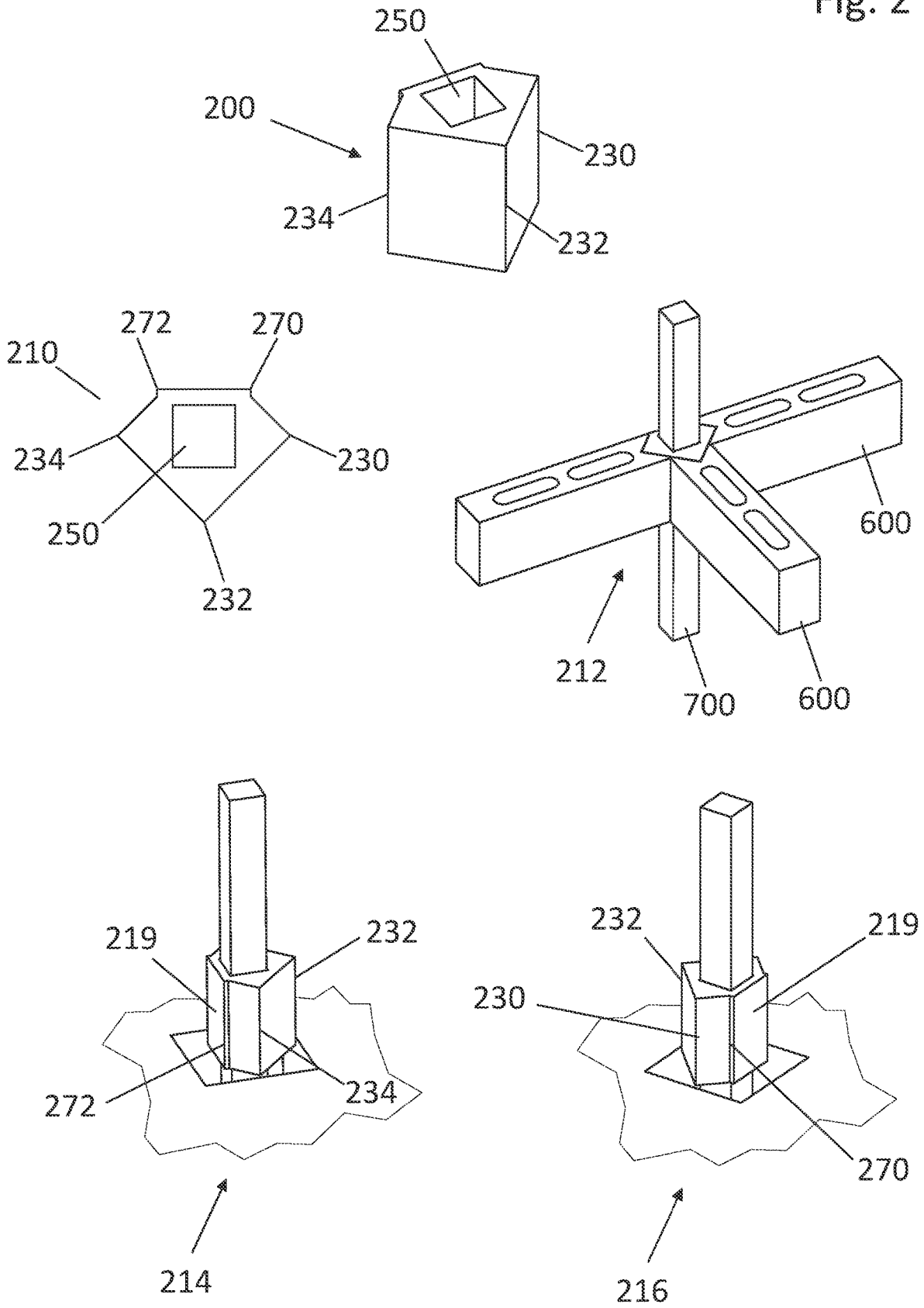
FIG. 2 is an illustration of various views of a T-joint block of the interlocking modular block system, in accordance with one embodiment.

FIG. 2 is an illustration of various views of a T-joint block 200 of the interlocking modular block system 100, in accordance with one embodiment. FIG. 2 shows multiple views of T-joint block 200: 210 is a top view, 212 is a top perspective view, 214 is a side perspective view and 216 is another side perspective view. T-joint block 200 is used to join three walls at a junction, wherein said three walls make 90-degree angles between.

The first triangular prism shaped protrusion 230 is adjacent to the second triangular prism shaped protrusion 232 and the third triangular prism shaped protrusion 234. In one embodiment, the tip of the protrusion 230 is about a 90-degree angle (same applies to other protrusions described herein). The triangular prism shaped protrusions are configured to fit within, and securely mate with, the triangular cutout of a wall block 600, 800 (see 212). The first triangular prism shaped protrusion 230 is adjacent to a lip or edge 270, which provides a narrow flat surface against which the point of a triangular cutout of a wall block 600, 800 may rest. The transition between the narrow flat surface of the lip or edge 270 and the slope of the protrusion 230 may be about 45 degrees from a straight line extending the narrow flat surface (the same applies to other lips or edges described herein). The third triangular prism shaped protrusion 234 is adjacent to a lip or edge 272, which also provides a narrow flat surface against which the point of a triangular cutout of a wall block 600, 800 may rest. Bore 250 has a square or rectangular shaped cross section that is configured to match the cross-sectional shape of the post 700 so as to provide a site for insertion of post 700. Bore 250 may run parallel to the longitudinal axes of the triangular prism shaped protrusions of the T-joint block. T-joint block also shows flat face 219 on one side.

Figure 3:
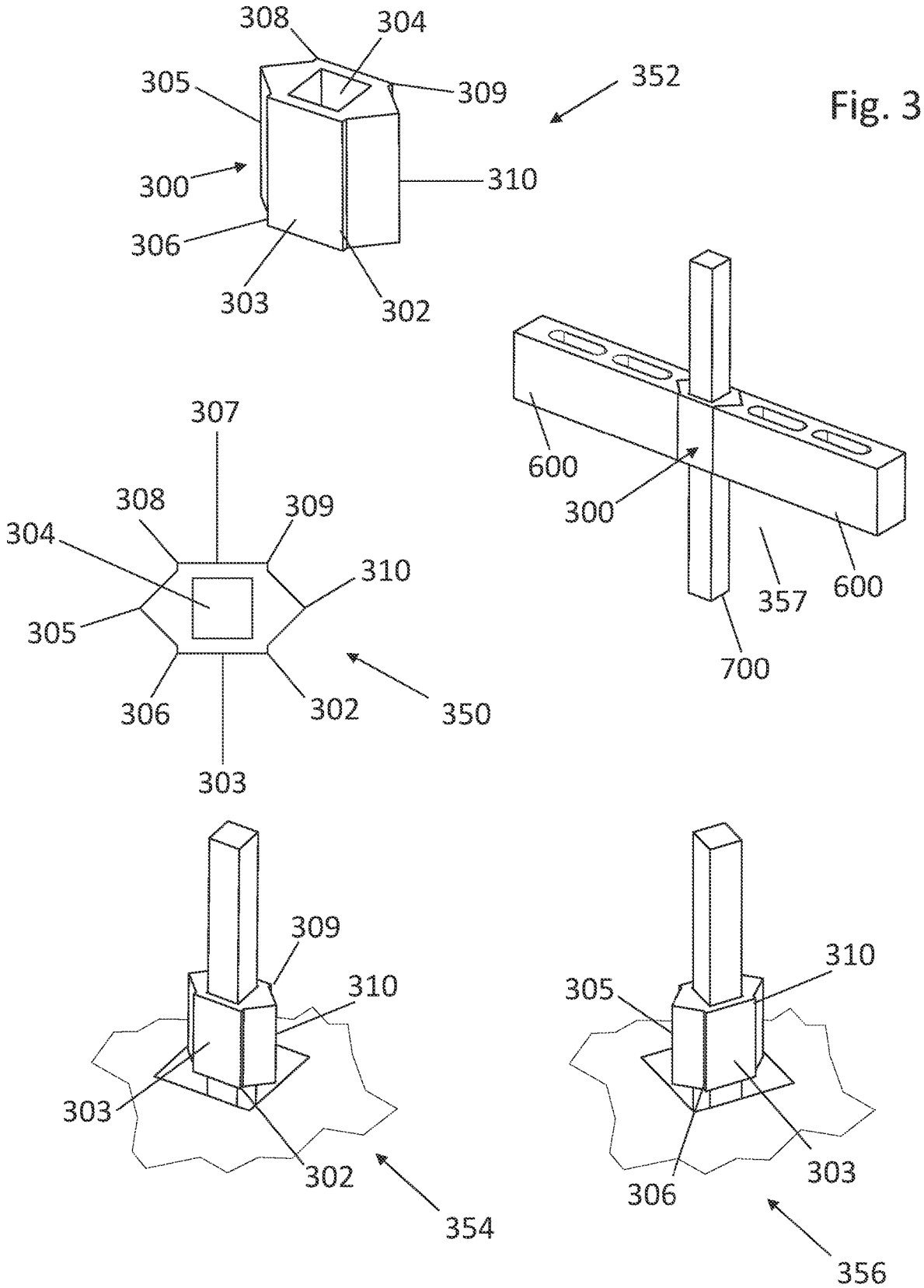
FIG. 3 is an illustration of various views of an intrawall block of the interlocking modular block system, in accordance with one embodiment.

FIG. 3 is an illustration of various views of an intrawall block 300 of the interlocking modular block system 100, in accordance with one embodiment. FIG. 3 shows multiple views of intrawall block 300: 350 is a top view, 352 is a top perspective view, 354 is a side perspective view, 356 is another side perspective view and 357 is another side perspective including the post 700. Intrawall block 300 is used to join two colinear walls at a junction, wherein said two walls make a 180-degree angle between. I.e., the intrawall block continues a first wall longitudinally by connecting or coupling it with a colinear second wall (see 357).

The first triangular prism shaped protrusion 305 is on an opposing face of the second triangular prism shaped protrusion 310. The triangular prism shaped protrusions are configured to fit within, and securely mate with, the triangular cutout of a wall block 600, 800. The first triangular prism shaped protrusion 305 is adjacent to lips or edges 306, 308, which provide a narrow flat surface against which the point of a triangular cutout of a wall block 600, 800 may rest. The second triangular prism shaped protrusion 310 is adjacent to lips or edges 302, 309, which also provides a narrow flat surface against which the point of a triangular cutout of a wall block 600, 800 may rest. Block 300 also has flat faces 303, 307 on sides opposing each other, and complementary to the sides on which the triangular prism shaped protrusions are located. Bore 304 has a square or rectangular shaped cross section that is configured to match the cross-sectional shape of the post 700 so as to provide a site for insertion of post 700. Bore 304 may run parallel to the longitudinal axes of the triangular prism shaped protrusions of the intrawall block.

Figure 4:
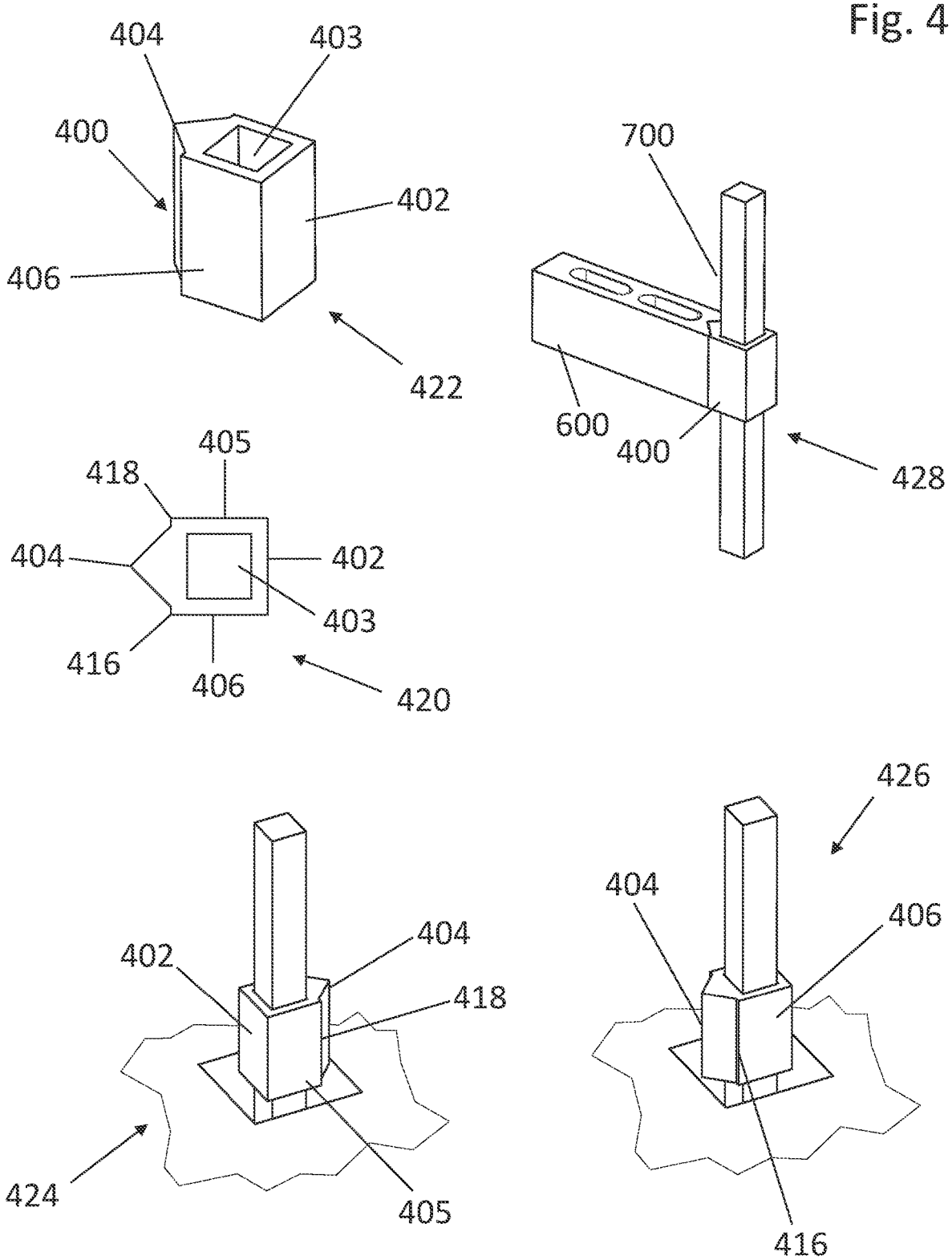
FIG. 4 is an illustration of various views of an end block of the interlocking modular block system, in accordance with one embodiment.

FIG. 4 is an illustration of various views of an end block 400 of the interlocking modular block system 100, in accordance with one embodiment. FIG. 4 shows multiple views of end block 400: 420 is a top view, 422 is a top perspective view, 424 is a side perspective view 426 is another side perspective view and 428 is another side perspective showing the post 700. End block 400 is used to terminate a wall, such that it is located at the end or terminator of a wall (see 428).

The first triangular prism shaped protrusion 404 is configured to fit within, and securely mate with, the triangular cutout of a wall block 600, 800. The first triangular prism shaped protrusion 404 is adjacent to lips or edges 416, 418, which provide a narrow flat surface against which the point of a triangular cutout of a wall block 600, 800 may rest. Block 400 also has three consecutive flat faces 406, 402, 405. Bore 403 has a square or rectangular shaped cross section that is configured to match the cross-sectional shape of the post 700 so as to provide a site for insertion of post 700. Bore 403 may run parallel to the longitudinal axis of the triangular prism shaped protrusions of the end block.

Figure 5:
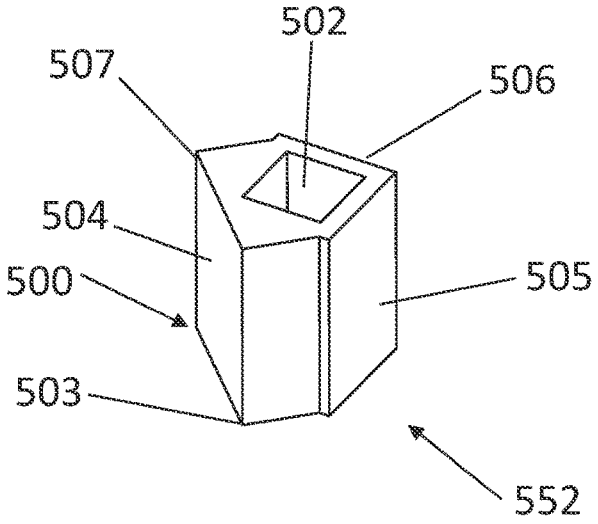
FIG. 5 is an illustration of various views of a corner block of the interlocking modular block system, in accordance with one embodiment.
Figure 5:
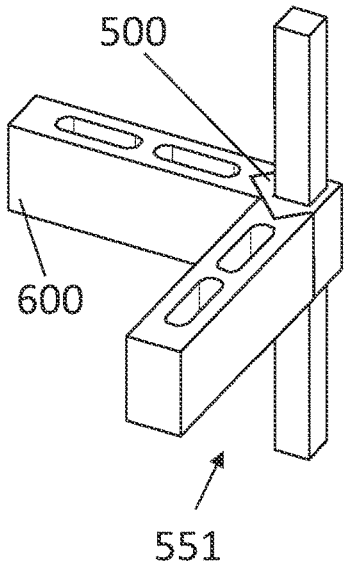
Figure 5:
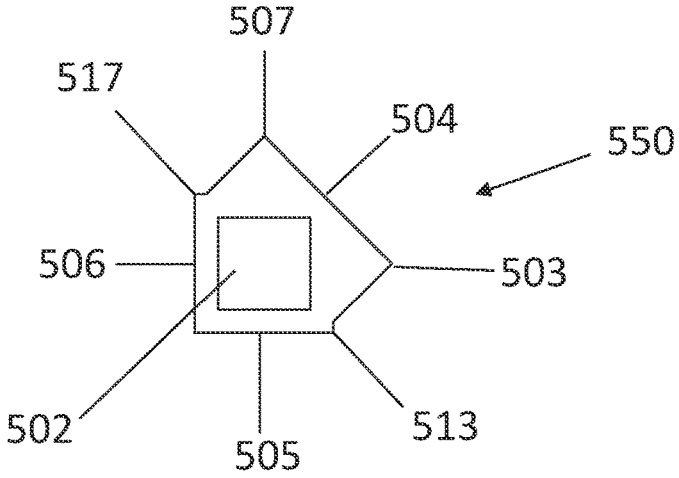
Figure 5:
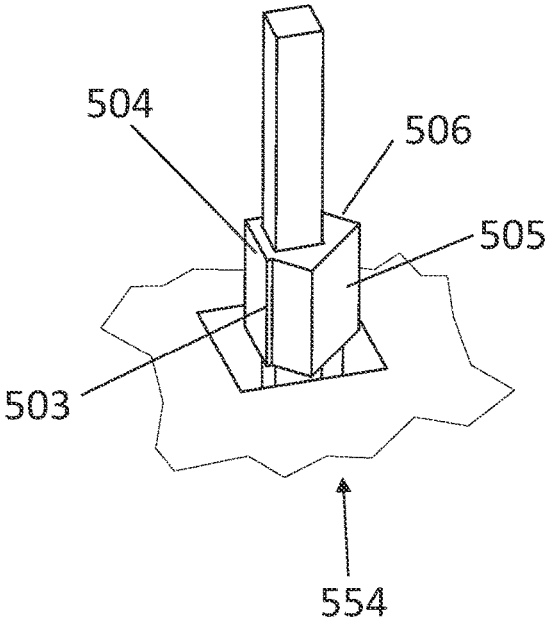

FIG. 5 is an illustration of various views of a corner block 500 of the interlocking modular block system 100, in accordance with one embodiment. FIG. 5 shows multiple views of corner block 500: 550 is a top view, 552 is a top perspective view, 554 is a side perspective view and 551 is another side perspective view. Corner block 500 is used to join two walls at a junction, wherein said two walls make a 90-degree angle between (see 551).

The first triangular prism shaped protrusion 507 is on a face adjacent and consecutive to the second triangular prism shaped protrusion 503. The triangular prism shaped protrusions are configured to fit within, and securely mate with, the triangular cutout of a wall block 600, 800. The first triangular prism shaped protrusion 507 is adjacent to lip or edge 517, which provides a narrow flat surface against which the point of a triangular cutout of a wall block 600, 800 may rest. The second triangular prism shaped protrusion 503 is adjacent to lip or edge 513, which also provides a narrow flat surface against which the point of a triangular cutout of a wall block 600, 800 may rest. Block 300 also has flat faces 506, 505 on adjacent sides consecutive to each other, and flat face 504. Bore 502 has a square or rectangular shaped cross section that is configured to match the cross-sectional shape of the post 700 so as to provide a site for insertion of post 700. Bore 502 may run parallel to the longitudinal axes of the triangular prism shaped protrusions of the corner block.

Figure 6:
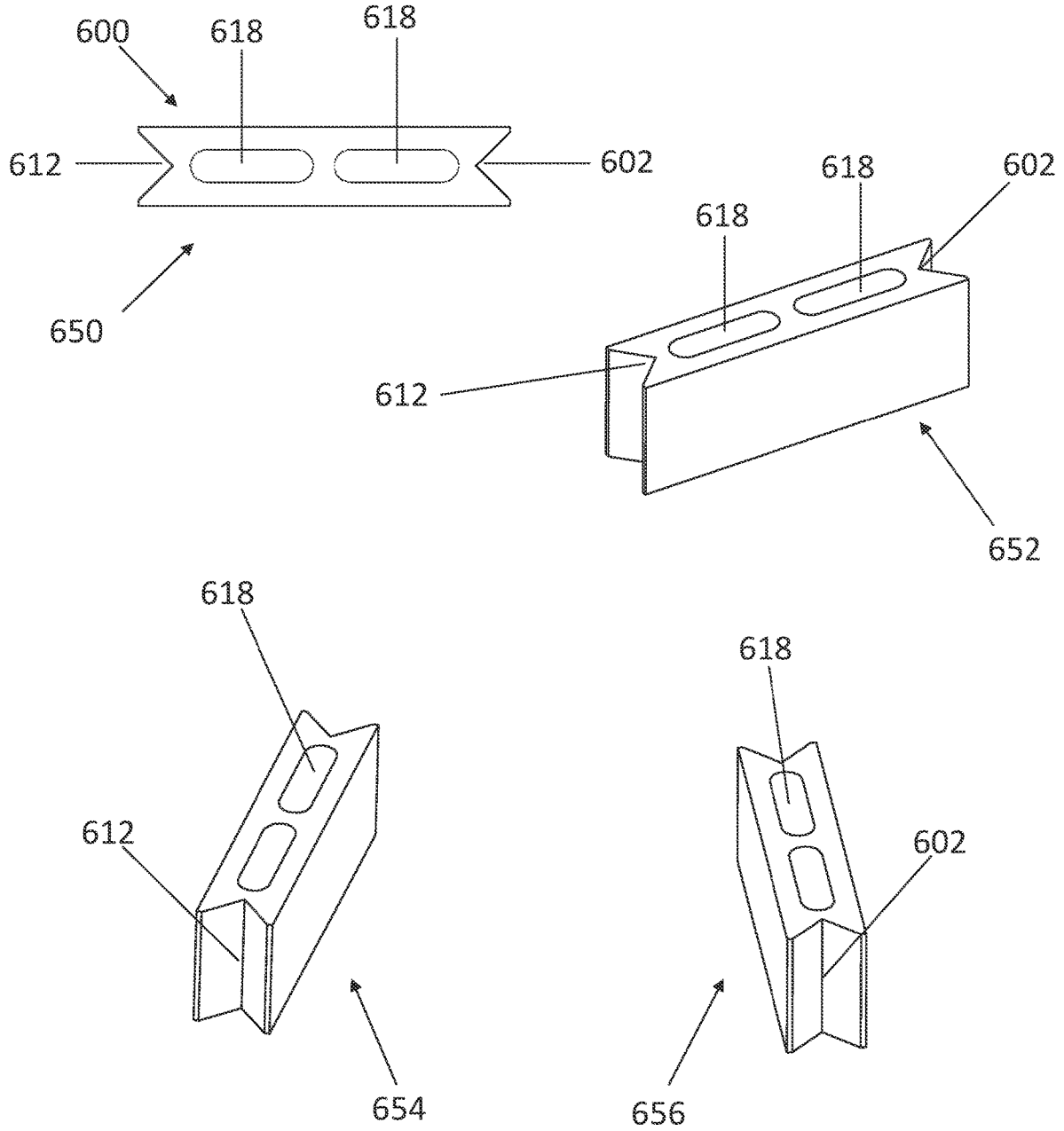
FIG. 6 is an illustration of various views of a wall block of the interlocking modular block system, in accordance with one embodiment.

FIG. 6 is an illustration of various views of a wall block 600 of the interlocking modular block system 100, in accordance with one embodiment. FIG. 6 shows multiple views of wall block 600: 650 is a top view, 652 is a top perspective view, 654 is a side perspective view and 656 is another side perspective view. Wall block 600 is used to fit between posts 700 and/or between blocks 200, 300, 400, 500 (see FIGS. 1-5).

Wall block 600 includes triangular cutouts 602, 612 on opposing sides, opposing faces, or opposing walls of the cuboid, preferably, the shortest and thinnest walls of the cuboid. The triangular prism shaped protrusions of blocks 200, 300, 400, 500 are shaped to fit securely within, or mate with, the triangular cutouts 602, 612 of the wall blocks. Also, the post 700 is shaped to fit securely within, or mate with, the triangular cutouts 602, 612 of the wall blocks. Wall block 600 includes multiple orifices 618 within the block, making it hollow, and allowing for insertion of mortar or other setting material.

Figure 7:
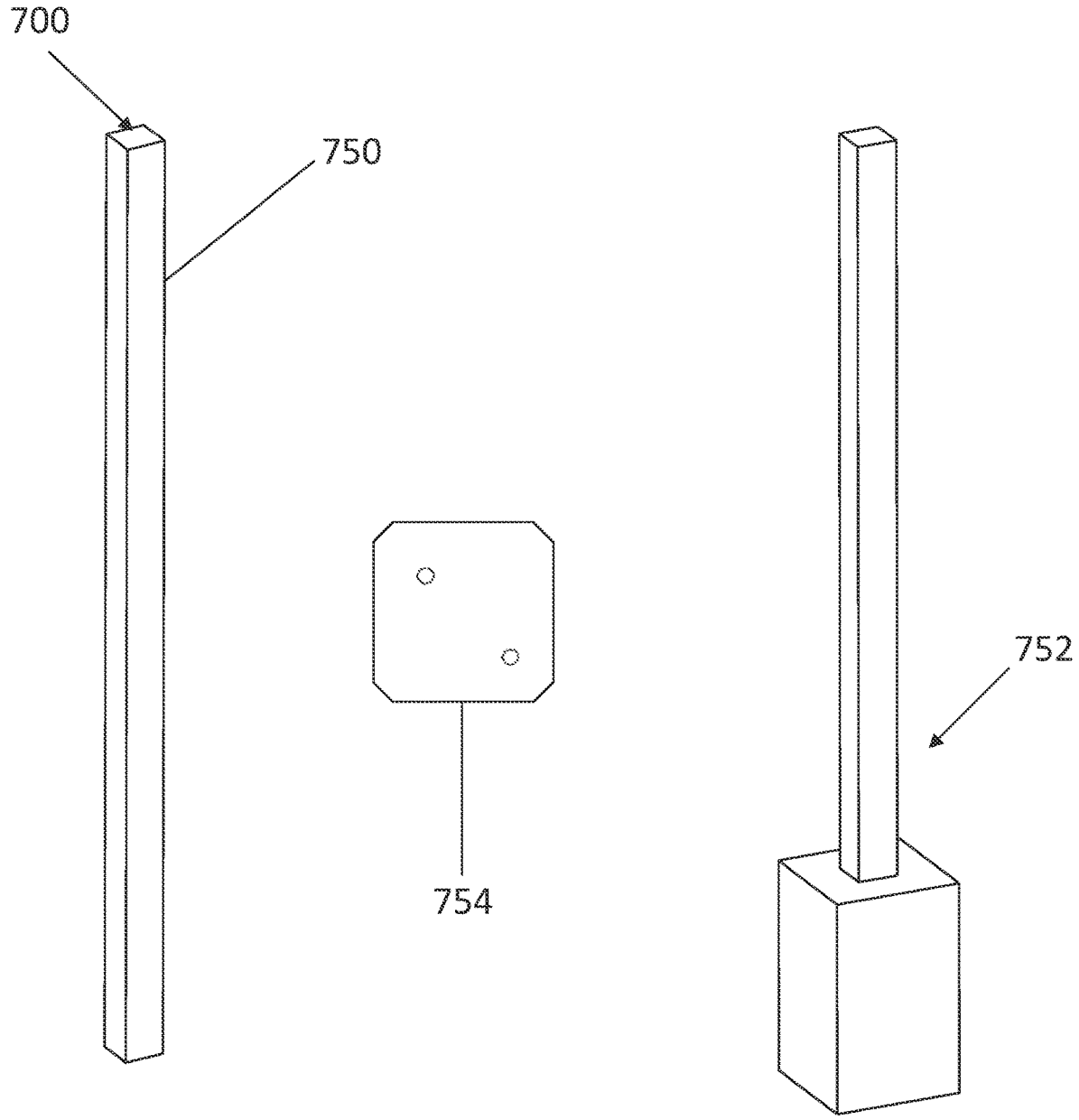
FIG. 7 is an illustration of various views of a post of the interlocking modular block system, in accordance with one embodiment.

FIG. 7 is an illustration of various views of a post 700 of the interlocking modular block system 100, in accordance with one embodiment. FIG. 7 shows multiple views of the post 700: 750 is a side view, 752 is a top perspective view, and 754 is a top view. FIG. 7 shows a solid prestressed concrete post 700. The concrete post 700 has a substantially square cross-sectional shape. Note that when said square shape is rotated 45 degrees, the shape is akin to a diamond. The purpose of the post 700 is to secure it to the ground using a concrete base, so as to provide a vertical structure to which the other block in this figure are attached. Also, the post 700 is shaped to fit securely within, or mate with, the triangular cutouts 602, 612 of the wall blocks. Further, the cross section of post 700 is shaped and configured to fit securely within, or mate with, the bores of blocks 200, 300, 400, 500 (see FIGS. 1-5).

Figure 8:
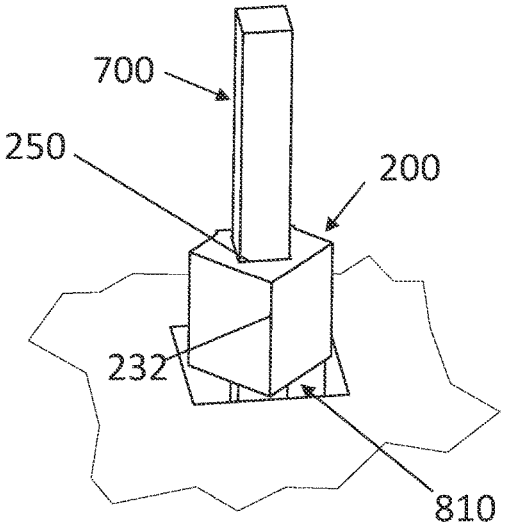
FIG. 8 is an illustration of a post coupled with a T-joint block of the interlocking modular block system, in accordance with one embodiment.

FIG. 8 is an illustration of a post 700 coupled with a T-joint block 200 of the interlocking modular block system 100, in accordance with one embodiment. Bore 250 in the block 200 provides a place for insertion of post 700 into the block. The cross section of post 700 is shaped and configured to fit securely within, or mate with, the bore of block 200. Once the post 700 exits the far side of the block, it is inserted into a hole 810 in the ground, which may be set with concrete or cement, and may serve as a foundation for a building. Triangular prism shaped protrusion 232 provides structure that enables block 200 to connect with other blocks, such as the wall block.

Figure 9:
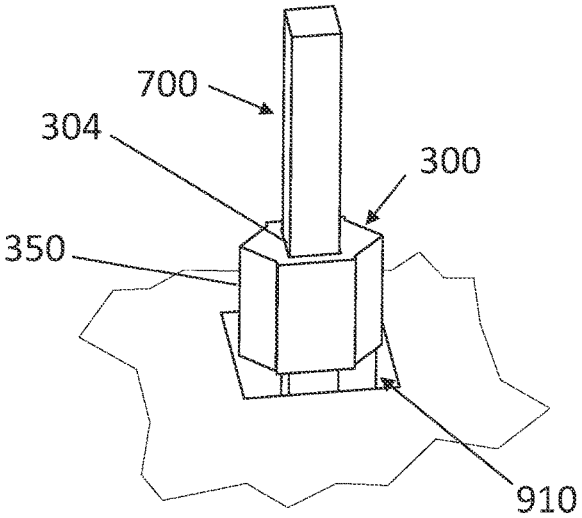
FIG. 9 is an illustration of a post coupled with an intrawall block of the interlocking modular block system, in accordance with one embodiment.

FIG. 9 is an illustration of a post 700 coupled with an intrawall block 300 of the interlocking modular block system 100, in accordance with one embodiment. Bore 304 in the block 300 provides a place for insertion of post 700 into the block. The cross section of post 700 is shaped and configured to fit securely within, or mate with, the bore of block 300. Once the post 700 exits the far side of the block, it is inserted into a hole 910 in the ground. Triangular prism shaped protrusion 305 provides structure that enables block 300 to connect with other blocks, such as the wall block.

Figure 10:
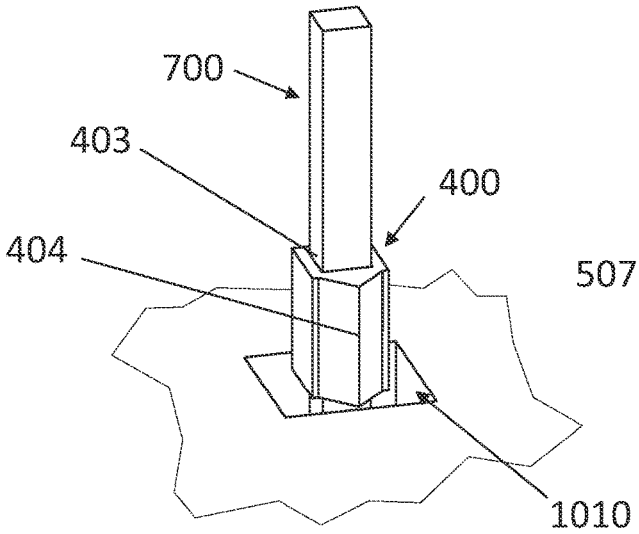
FIG. 10 is an illustration of a post coupled with an end block of the interlocking modular block system, in accordance with one embodiment.

FIG. 10 is an illustration of a post 700 coupled with an end block 400 of the interlocking modular block system 100, in accordance with one embodiment. Bore 403 in the block 400 provides a place for insertion of post 700 into the block. The cross section of post 700 is shaped and configured to fit securely within, or mate with, the bore of block 400. Once the post 700 exits the far side of the block, it is inserted into a hole 1010 in the ground. Triangular prism shaped protrusion 404 provides structure that enables block 400 to connect with other blocks, such as the wall block.

Figure 11:
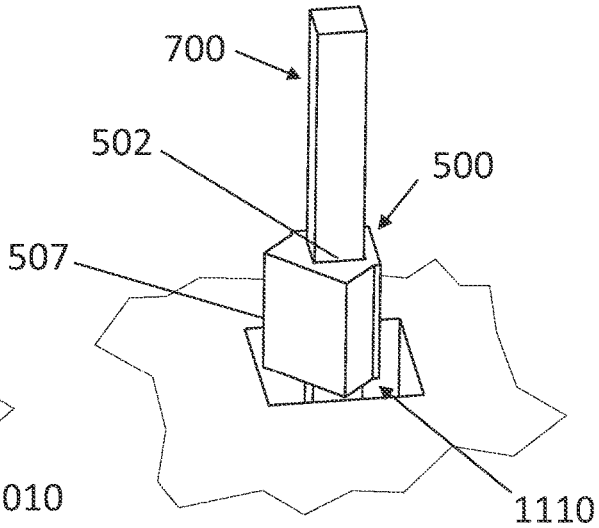
FIG. 11 is an illustration of a post coupled with a corner block of the interlocking modular block system, in accordance with one embodiment.

FIG. 11 is an illustration of a post 700 coupled with a corner block 500 of the interlocking modular block system 100, in accordance with one embodiment. Bore 502 in the block 500 provides a place for insertion of post 700 into the block. The cross section of post 700 is shaped and configured to fit securely within, or mate with, the bore of block 500. Once the post 700 exits the far side of the block, it is inserted into a hole 1110 in the ground. Triangular prism shaped protrusion 507 provides structure that enables block 400 to connect with other blocks, such as the wall block.

Figure 12:
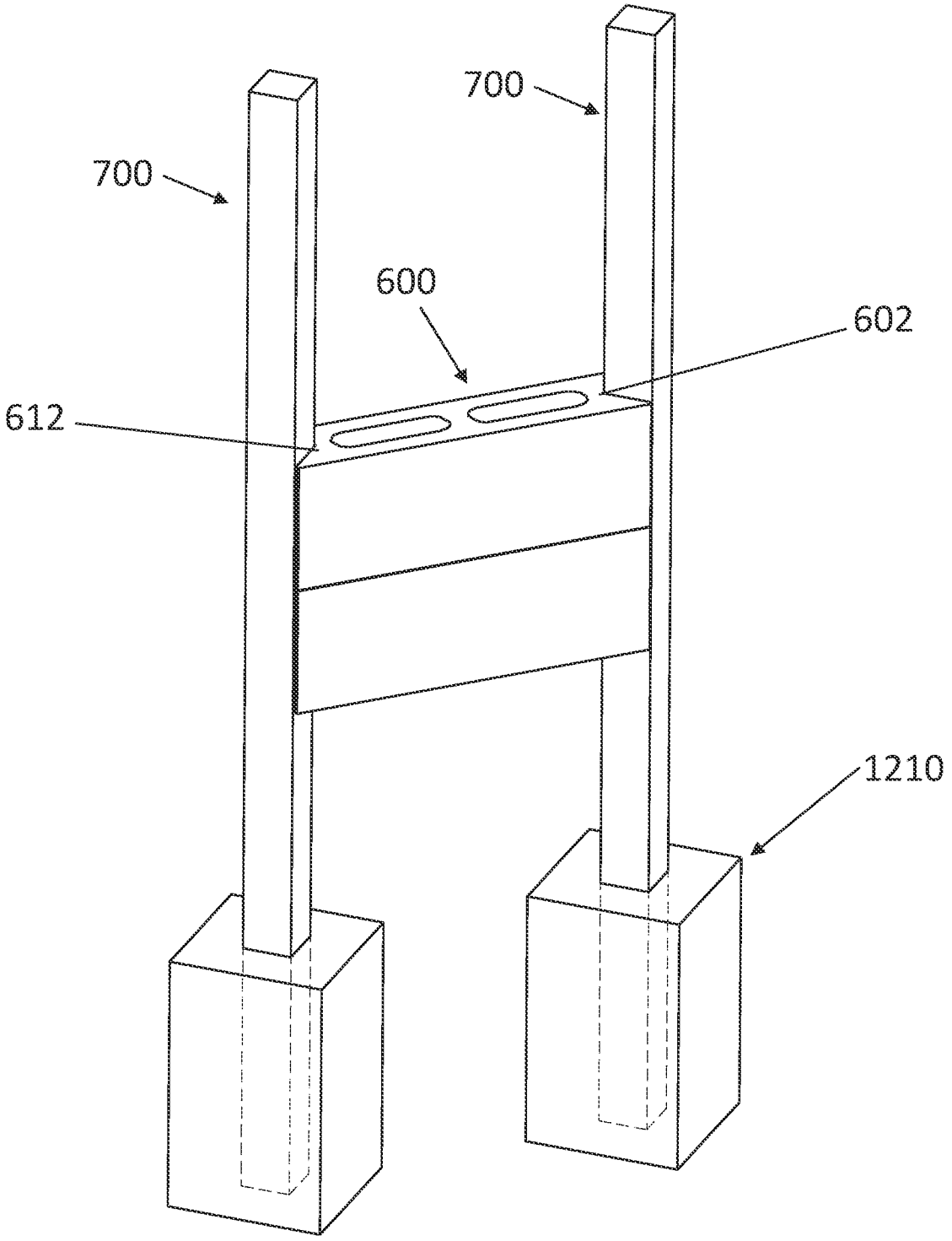
FIG. 12 is an illustration of a post coupled with a wall block of the interlocking modular block system, in accordance with one embodiment.

FIG. 12 is an illustration of a post 700 coupled with a wall block 600 of the interlocking modular block system 100, in accordance with one embodiment. Triangular cutout 602 in the block 600 provides a place for insertion of post 700 against the block. The cross section of post 700 is shaped and configured to fit securely within, or mate with, the triangular cutout 602 in the block 600. The end of the post 700 is inserted into a hole 1210 in the ground which may be filled with concrete to shore up the post 700.

Figure 13:
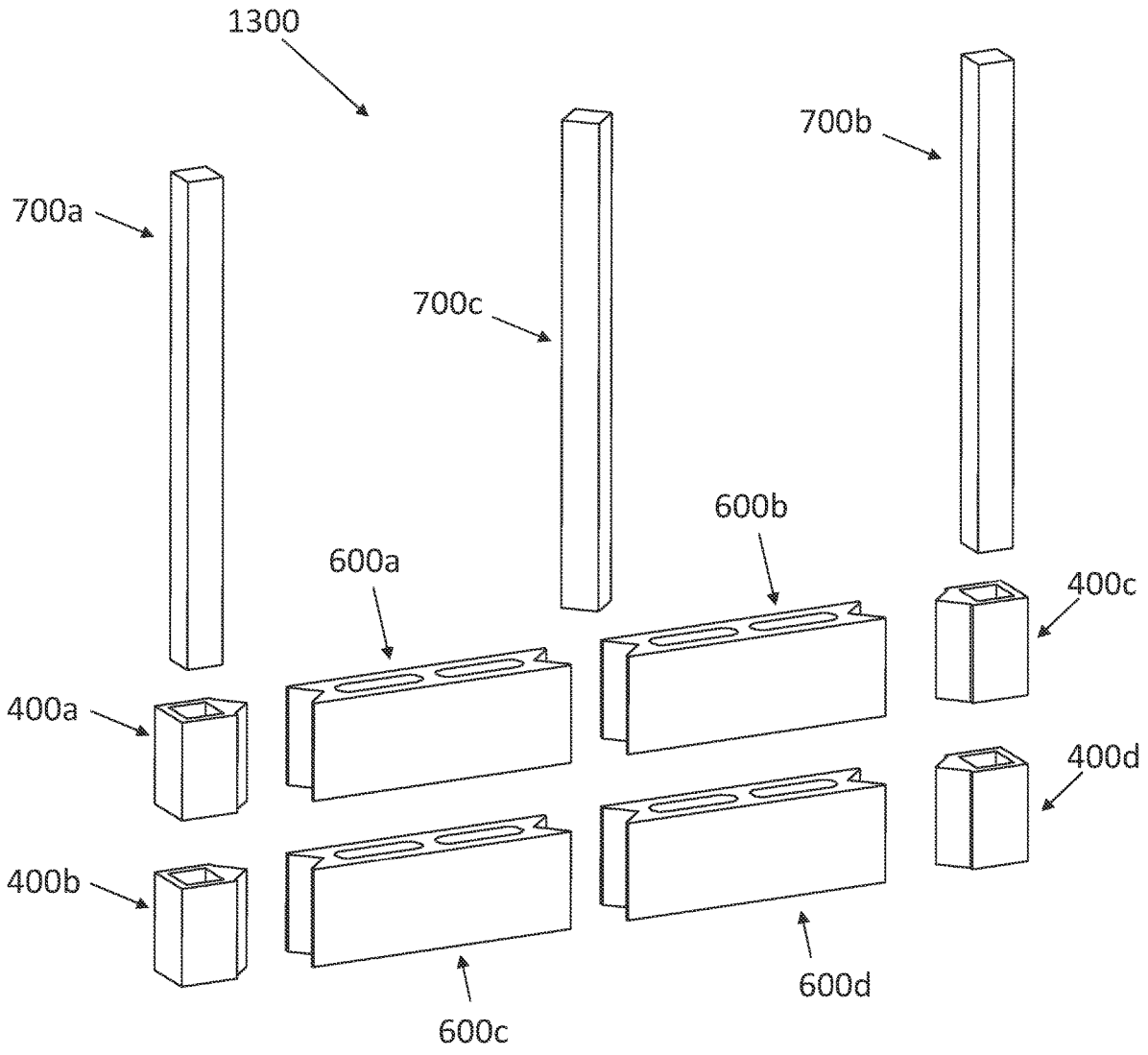
FIG. 13 is an illustration of an exploded view of a simple wall built with the interlocking modular block system, in accordance with one embodiment.

FIG. 13 is an illustration of an exploded view of a simple wall 1300 built with the interlocking modular block system 100, in accordance with one embodiment. FIG. 13 shows post 700*a* in relation to end blocks 400*a*, 400*b*, the post 700*a* for insertion into the bores of the end blocks 400*a*, 400*b*, as shown in FIG. 10, and further securing to the ground. FIG. 13 also shows post 700*b* in relation to end blocks 400*c*, 400*d*, the post 700*b* for insertion into the bores of the end blocks 400*c*, 400*d*, as shown in FIG. 10, and further securing to the ground.

FIG. 13 also shows wall block 600*a* situated between block 400*a* and post 700*c*, wherein the triangular prism shaped protrusion of block 400*a* is inserted into the left side triangular cutout of block 600*a*, and wherein one triangular side of the post 700*c* is inserted into the right-side triangular cutout of block 600*a* such that the block 600*a* is held securely between block 400*a* and post 700*c*. Similarly, block 600*c* is held securely between block 400*b* and post 700*c*.

FIG. 13 also shows wall block 600*b* situated between block 400*c* and post 700*c*, wherein the triangular prism shaped protrusion of block 400*c* is inserted into the right-side triangular cutout of block 600*b*, and wherein one triangular side of the post 700*c* is inserted into the left side triangular cutout of block 600*b* such that the block 600*b* is held securely between block 400*c* and post 700*c*. Similarly, block 600*d* is held securely between block 400*d* and post 700*c*.

Figure 14:
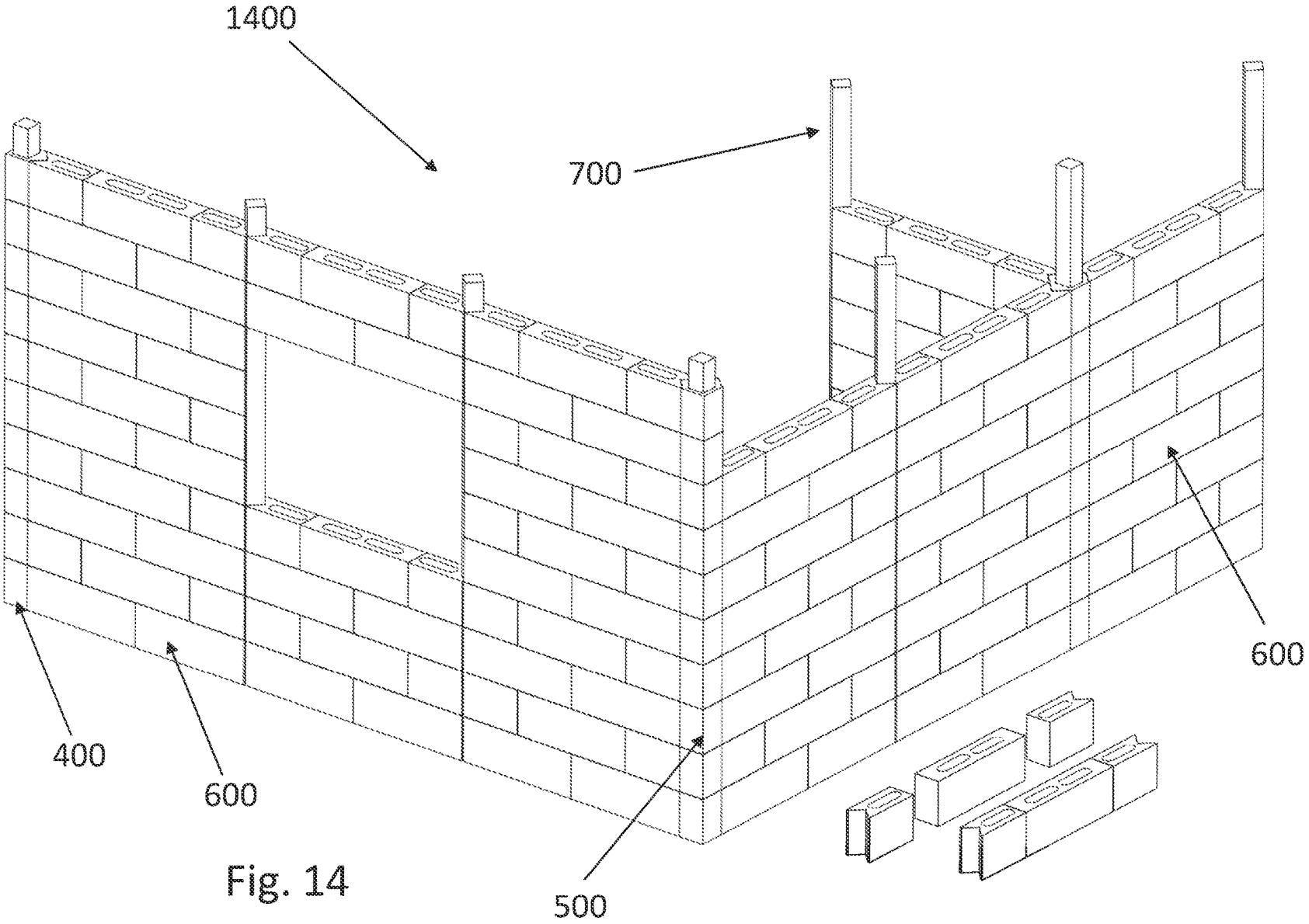
FIG. 14 is an illustration of a sample structure built with the interlocking modular block system, in accordance with one embodiment.

FIG. 14 is an illustration of a sample structure 1400 built with the interlocking modular block system 100, in accordance with one embodiment. FIG. 14 shows how the components comprising the end block 400, the post 700 and the wall block 600 can be used to construct a simple structure 1400.

Blocks 200, 300, 400, 500, 600, 800 and post 700 may be composed of concrete, reinforced concrete, prestressed concrete, lightweight concrete, high density concrete, air entrained concrete, high strength concrete, high performance concrete, ultra-high performance concrete, self-consolidating concrete, shotcrete, limecrete, ready mix concrete, rapid set concrete, smart concrete, pervious concrete, pumped concrete, roll compacted concrete, asphalt concrete, glass concrete, recyclable materials, and the like.

Although specific embodiments of the claimed embodiments have been disclosed, those having ordinary skill in the art will understand that changes can be made to the specific embodiments without departing from the spirit and scope of the claimed embodiments. The scope of the claimed embodiments is not to be restricted, therefore, to the specific embodiments. Furthermore, it is intended that the appended claims cover any and all such applications, modifications, and embodiments within the scope of the claimed embodiments.

Embodiments herein, for example, are described above with reference to block diagrams and/or operational illustrations of methods and systems, according to said embodiments. The functions/acts noted in the blocks may occur out of the order as shown in any flowchart. For example, two blocks shown in succession may in fact be executed substantially concurrently or the blocks may sometimes be executed in the reverse order, depending upon the functionality/acts involved.

While certain embodiments have been described, other embodiments may exist. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. An interlocking modular block system for structure assembly, comprising:

a. a solid prestressed concrete post having a square cross-sectional shape;

b. a first hollow cuboid shaped block of a first size, having a triangular cutout on each of two opposing sides, wherein each triangular cutout is configured to mate with an instance of said post;

c. a second hollow cuboid shaped block of a second size longer than the first size, having said triangular cutout each of two opposing sides;

d. a first hollow cubic shaped block with a triangular prism shaped protrusion on each of three consecutive walls, including a square shaped bore configured to securely accept said post, wherein said first hollow cubic shaped block is configured to join three walls and wherein said triangular prism shaped protrusion is configured to mate with an instance of said triangular cutout;

e. a second hollow cubic shaped block with a triangular prism shaped protrusion on each of two opposing walls, including a square shaped bore configured to securely accept said post, wherein said second hollow cubic shaped block is configured to join two colinear walls;

f. a third hollow cubic shaped block with a triangular prism shaped protrusion on one wall, including a square shaped bore configured to securely accept said post, wherein said third hollow cubic shaped block is configured to terminate a wall; and g. a fourth hollow cubic shaped block with a triangular prism shaped protrusion on each of two consecutive walls, including a square shaped bore configured to securely accept said post, wherein said fourth hollow cubic shaped block is configured to join two perpendicular walls.

2. The interlocking modular block system of claim 1, wherein the solid prestressed concrete post includes a first side that is configured for mating with a triangular cutout of the first hollow cuboid shaped block.

3. The interlocking modular block system of claim 2, wherein the first hollow cubic shaped block further comprises a lip adjacent to two of said three triangular prism shaped protrusions on the first hollow cubic shaped block.

4. The interlocking modular block system of claim 3, wherein the second hollow cubic shaped block further comprises a pair of lips on either side of said two triangular prism shaped protrusions on the second hollow cubic shaped block.

5. The interlocking modular block system of claim 4, wherein the third hollow cubic shaped block further comprises a pair of lips on either side of the triangular prism shaped protrusion on the third hollow cubic shaped block.

6. The interlocking modular block system of claim 5, wherein the fourth hollow cubic shaped block further comprises a lip adjacent to each of said two triangular prism shaped protrusions on the fourth hollow cubic shaped block.

7. The interlocking modular block system of claim 6, wherein the square shaped bore of the first, second, third and fourth hollow cubic shaped blocks is configured to match the square cross-sectional shape of the solid prestressed concrete post.

8. The interlocking modular block system of claim 7, wherein the first and second hollow cuboid shaped blocks, and the first, second, third and fourth hollow cubic shaped blocks are composed of concrete.

9. The interlocking modular block system of claim 8, wherein the first and second hollow cuboid shaped blocks, and the first, second, third and fourth hollow cubic shaped blocks are composed of a recycled material.

10. An interlocking modular block system for structure assembly, comprising:

a. a solid prestressed concrete post having a square cross-sectional shape;

b. a first hollow cuboid shaped block of a first size, having a triangular cutout on each of two opposing sides, wherein each triangular cutout is configured to mate with an instance of said post;

c. a second hollow cuboid shaped block of a second size longer than the first size, having said triangular cutout each of two opposing sides;

d. a first hollow cubic shaped block with a triangular prism shaped protrusion on each of three consecutive walls, including a square shaped bore configured to securely accept said post, said square shaped bore extending parallel to longitudinal axes of said triangular prism shaped protrusions, wherein said first hollow cubic shaped block is configured to join three walls and wherein said triangular prism shaped protrusion is configured to mate with an instance of said triangular cutout;

e. a second hollow cubic shaped block with a triangular prism shaped protrusion on each of two opposing walls, including a square shaped bore configured to securely accept said post, said square shaped bore extending parallel to longitudinal axes of said triangular prism shaped protrusions, wherein said second hollow cubic shaped block is configured to join two colinear walls;

f. a third hollow cubic shaped block with a triangular prism shaped protrusion on one wall, including a square shaped bore configured to securely accept said post, said square shaped bore extending parallel to a longitudinal axis of said triangular prism shaped protrusion, wherein said third hollow cubic shaped block is configured to terminate a wall; and g. a fourth hollow cubic shaped block with a triangular prism shaped protrusion on each of two consecutive walls, including a square shaped bore configured to securely accept said post, said square shaped bore extending parallel to longitudinal axes of said triangular prism shaped protrusions, wherein said fourth hollow cubic shaped block is configured to join two perpendicular walls.

11. The interlocking modular block system of claim 10, wherein the solid prestressed concrete post includes a first side that is configured for mating with a triangular cutout of the first hollow cuboid shaped block.

12. The interlocking modular block system of claim 11, wherein the first hollow cubic shaped block further comprises a lip adjacent to two of said three triangular prism shaped protrusions on the first hollow cubic shaped block.

13. The interlocking modular block system of claim 12, wherein the second hollow cubic shaped block further comprises a pair of lips on either side of said two triangular prism shaped protrusions on the second hollow cubic shaped block.

14. The interlocking modular block system of claim 13, wherein the third hollow cubic shaped block further comprises a pair of lips on either side of the triangular prism shaped protrusion on the third hollow cubic shaped block.

15. The interlocking modular block system of claim 14, wherein the fourth hollow cubic shaped block further comprises a lip adjacent to each of said two triangular prism shaped protrusions on the fourth hollow cubic shaped block.

16. The interlocking modular block system of claim 15, wherein the square shaped bore of the first, second, third and fourth hollow cubic shaped blocks is configured to match the square cross-sectional shape of the solid prestressed concrete post.

17. The interlocking modular block system of claim 16, wherein the first and second hollow cuboid shaped blocks, and the first, second, third and fourth hollow cubic shaped blocks are composed of concrete.

18. The interlocking modular block system of claim 17, wherein the first and second hollow cuboid shaped blocks, and the first, second, third and fourth hollow cubic shaped blocks are composed of a recycled material.

* * * * *